US006292075B1

(12) United States Patent
Connell et al.

(10) Patent No.: US 6,292,075 B1
(45) **Date of Patent: *Sep. 18, 2001**

(54) TWO POLE CONTACTOR

(75) Inventors: Richard Anthony Connell, Cottenham; Brian Stanley Darlow, Bottisham, both of (GB)

(73) Assignee: B L P Components, Suffolk (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/380,117

(22) PCT Filed: Dec. 26, 1998

(86) PCT No.: PCT/GB98/00612

§ 371 Date: Nov. 12, 1999

§ 102(e) Date: Nov. 12, 1999

(87) PCT Pub. No.: WO98/40898

PCT Pub. Date: Sep. 17, 1998

(30) Foreign Application Priority Data

Mar. 8, 1997 (GB) ..... 9704860
Jul. 3, 1997 (GB) ..... 9713962

(51) Int. Cl.[7] ..... H01H 3/00
(52) U.S. Cl. ..... 335/185; 335/251; 335/257; 335/132

(58) Field of Search ..... 335/185–195, 335/250–251, 257

(56) References Cited

U.S. PATENT DOCUMENTS

| | | | | |
|---|---|---|---|---|
| 3,594,668 | * | 7/1971 | Clarke et al. | 335/13 |
| 3,984,795 | | 10/1976 | Gaskill | 335/170 |
| 4,388,535 | * | 6/1983 | Wiktor et al. | 307/113 |
| 4,430,579 | * | 2/1984 | Wiktor | 307/134 |
| 4,491,812 | * | 1/1985 | Happach | 335/184 |
| 4,529,953 | * | 7/1985 | Myers | 335/126 |
| 5,272,458 | | 12/1993 | Hoffman | 335/179 |

FOREIGN PATENT DOCUMENTS

| | | |
|---|---|---|
| 854030 | 11/1960 | (GB) . |
| 1 057 058 | 2/1967 | (GB) . |
| 1 408 924 | 10/1975 | (GB) . |
| 2 192 306 | 1/1988 | (GB) . |
| 2 227 608 | 8/1990 | (GB) . |

* cited by examiner

*Primary Examiner*—Lincoln Donovan
*Assistant Examiner*—Tuyen T. Nguyen
(74) *Attorney, Agent, or Firm*—Lee, Mann, Smith, McWilliam Sweeney & Ohlson

(57) ABSTRACT

A two pole contactor, particularly for a domestic electricity meter, comprising a solenoid with a plunger actuator and a movable contact for each pole mounted on a pivotal blade in a symmetrical opposed configuration. The plunger is connected to the blades by a leaf spring whose ends engage sliders connected to the blades to impart a similar and even movement to each blade.

8 Claims, 4 Drawing Sheets

TWO POLE CONTACTOR

FIELD OF INVENTION

The present invention relates to a two pole contactor, particularly for use in domestic electricity meters in which it is desired to have a total isolation between the utility or electricity supply metering side and the domestic circuits.

BACKGROUND TO THE INVENTION

The distribution system in North America is such that domestic premises are fed with a 2-phase (180° phase relationship) utility supply, the local transformer centre tap giving an artificial Neutral for normal low-current loads at 115 V, while the voltage across phases is 230 V for power loads such as air-conditioning, motor drives and heaters. The local transformer primary is usually fed from an overhead fused 25 KV supply, so that the contactor switch contacts must safely withstand any reasonable short-circuit fault on the load side of the meter.

Known contactor designs exist for performing such switching functions in association with domestic electricity meters used in North America.

In U.S. Pat. No. 4,388,535 the feed connections are provided with sets of fixed pairs of contacts, and related sets of sprung, contacted shorting bars are positioned in proximity to the fixed contact sets, such that when they are actuated the two switch sets make contact, connecting the feed or utility side to the domestic load side.

Actuation is achieved by a moving plunger within a power solenoid coil, and a set of pivoted bellcrank levers operate to push open the sprung shorting bars or to retract to close them, the spring forces providing the necessary contact closure. A microswitch is used to interrupt the solenoid coil drive during the OPEN and CLOSE actuation functions, ensuring that the energisation is only momentary, thus preventing the coil from over-heating and possible burn-out.

In U.S. Pat. No. 4,430,579 the construction is similar to U.S. Pat. No. 4,338,535, using sprung contacted shorting bar switch sets to create the 2-pole contactor function. But the actuation method adopted is different in that the solenoid is double-acting, the plunger being naturally attracted centrally into a power drive coil when energised, this being the point of greatest flux concentration. In being attracted centrally, the plunger is dynamically over-driven past its centre to mechanically latch at each end of its stroke. The coil power is typically 2,000 W for a reliable double-action mechanical latching function.

This solenoid double-action is used to translate the switching function via suitably guided roller-aided push rods, either to CLOSE or OPEN the two sprung switch sets, the contact closure force being provided by the compression springs behind each shorting bar. In order to ensure that the contacts do not separate under short-circuit fault conditions, a relatively high force must be applied by each compression spring.

The solenoid plunger is profiled in such a way as to perform both the translation and mechanical latching functions simultaneously. A variant of the profiled plunger uses a similarly profiled, hardened steel plate suitably pinned to the plunger, to perform the same mechanical translation and latching functions, respectively. A microswitch is again used to interrupt the solenoid coil drive to prevent the coil from over-heating.

It is an object of the present invention to provide an improved two-pole contactor.

SUMMARY OF THE INVENTION

According to one aspect of the present invention there is provided a two-pole contactor comprising a solenoid having a plunger actuator, a fixed contact and a moveable contact for each pole, the moveable contacts being each symmetrically mounted on a pivotal blade, in which the plunger is connected to the centre of a leaf spring, whereby in use the ends thereof impart a similar and even movement to each blade.

According to another aspect of the present invention there is provided a contactor having at least a single pole pair of contacts and a solenoid operated plunger to actuate the contacts, in which the part of the plunger external to the solenoid is made of non-magnetic material to reduce the influence of the interfering magnetic fields during the excess current or short-circuit fault conditions.

According to a further aspect of the present invention there is provided a contactor comprising a solenoid with a plunger actuator mounted within a metal frame and biased by a spring to the open condition of the contactor, the plunger contacting a stop on the frame in the closed condition, in which the status of the contactor is determined by passing a voltage between the frame and the spring, so that a circuit is made when the plunger contacts the stop in said closed condition.

Other features of the invention are defined in the appended claims.

BRIEF DESCRIPTION OF THE DRAWINGS

A contactor in accordance with the invention will now be described, by way of example only, with reference to the accompanying drawings in which.

DETAILED DESCRIPTION

Figure 1:
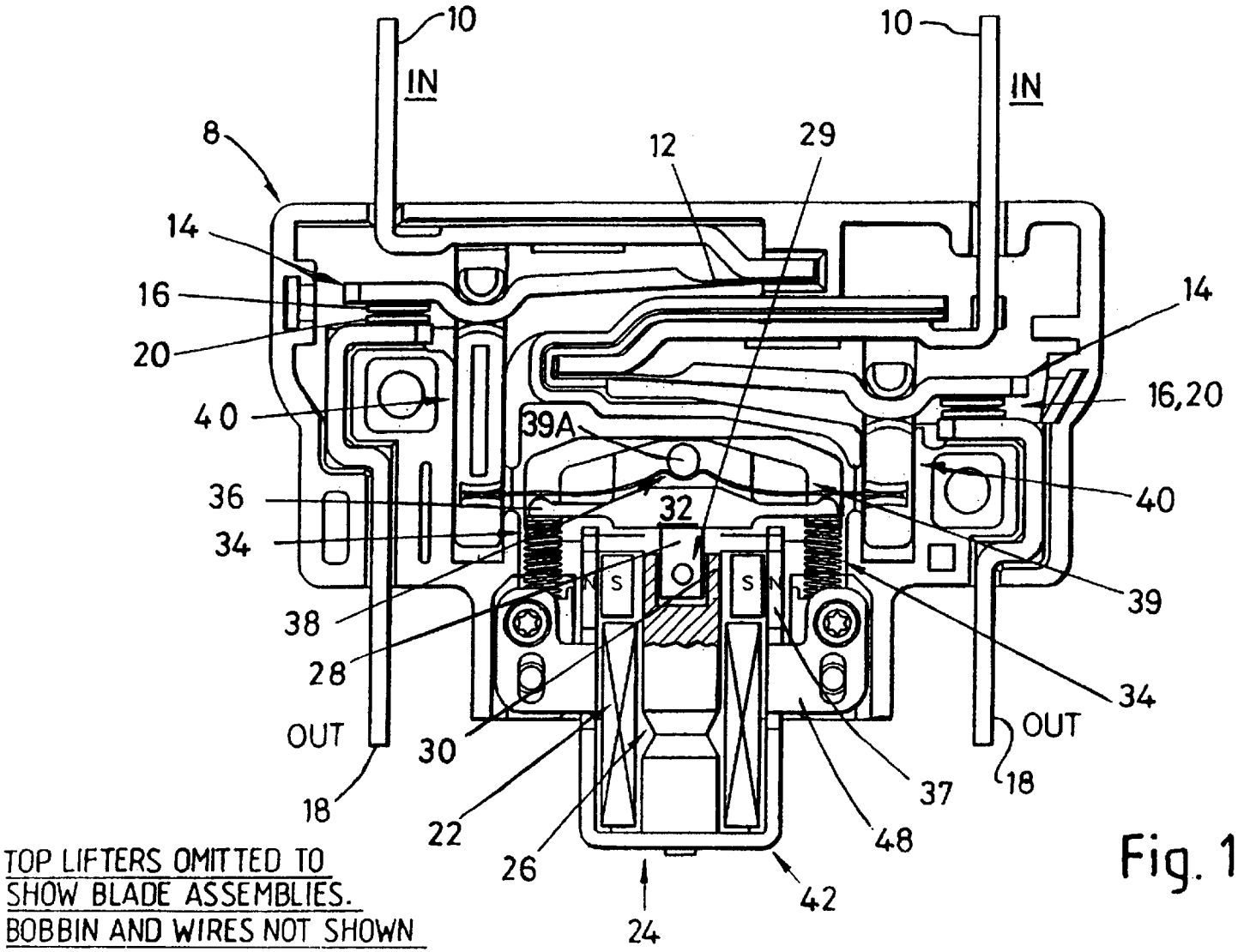
FIG. 1 is a plan view of the contactor with the top removed to show the blade assemblies.
Figure 2A:
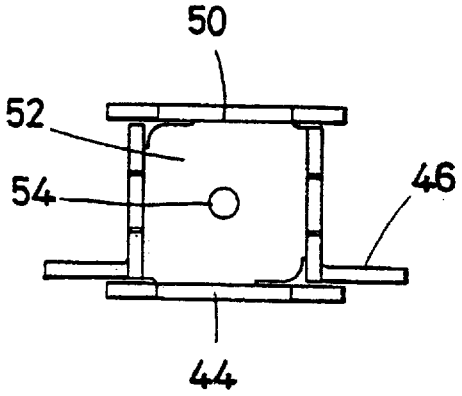
FIGS. 2A to 2D are views of a U-frame for the shrouded solenoid, showing respectively a view from above, a plan view taken on the partial section line II—II of FIG. 2A, a side view, and a view from beneath the frame.
Figure 2B:
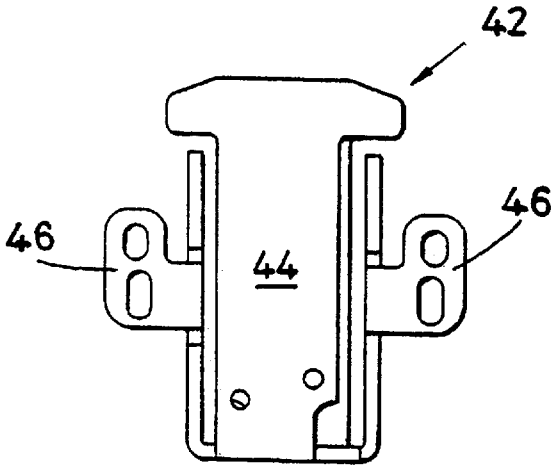
Figure 2C:
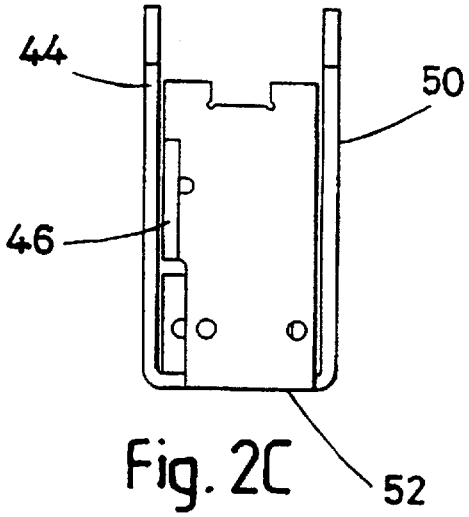
Figure 2D:
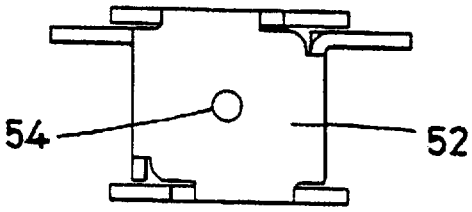

Referring first to FIG. 1, the contactor shown is designed to be fitted within a domestic electricity meter casing, or into a meter base moulding at the interface of a house, for isolating the mains utility power feed to domestic loads within the house. It may also be integrated into a proposed automatic meter reading (AMR) pre-payment and communication system, with the option of remote disconnection and reconnection of the customer's supply. The contactor comprises a stout moulded casing 8 made of an electrically non-conductive material and which forms a base into which are mounted two separate balanced and symmetrical mirror-image switching systems.

In order to avoid unnecessary repetition of references in the drawings, only the left-hand parts of the switch will generally be referred to, it being understood that the right-hand parts are essentially similar except where specifically stated.

Figure 3A:
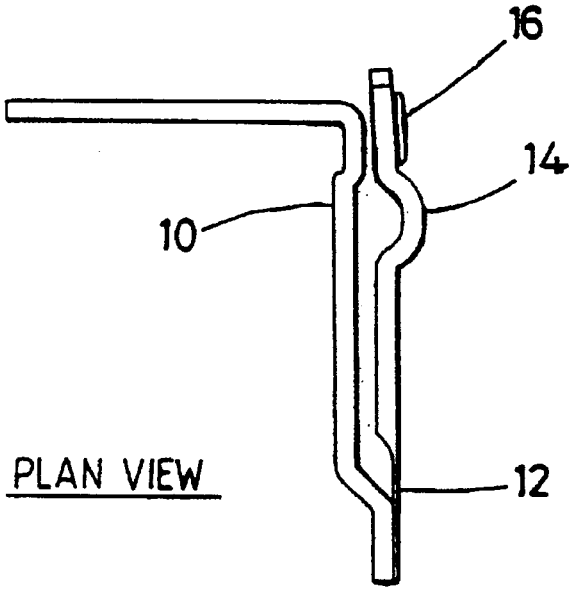
FIGS. 3A and 3B are views from one side and beneath respectively of a bus-bar assembly incorporating a moving blade.
Figure 3B:
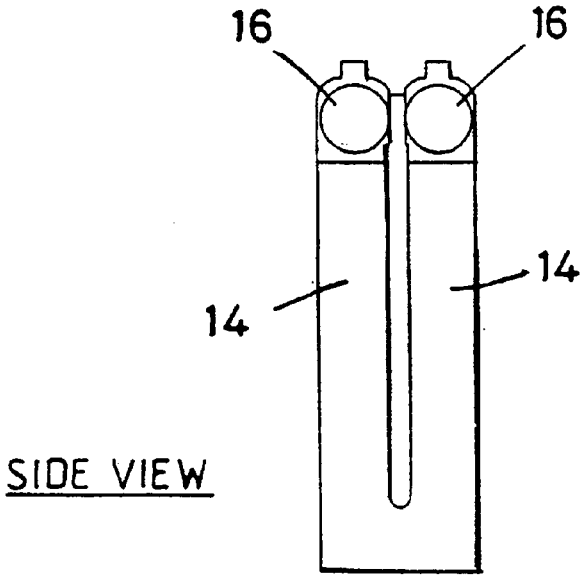

Power is fed to the contactor from an inlet bus-bar 10 which is connected by a thin spring portion 12 to a bi-furcated moving blade 14 having a pair of inlet contacts 16 formed at the ends (see also FIGS. 3A and 3B). Power is delivered out of the contactor from an outlet bus-bar 18 which has fixed double contacts 20 for mating with the inlet contacts 16.

Mounted centrally between the ends of the outlet bus-bars 18 is a solenoid actuator 24 comprising a ferrous plunger 26 slidable within a solenoid drive coil 22.

A spigot 28 connected to a yoke 32 engages loosely within an aperture 30 in the plunger 26, to which it is connected by a pivot pin 29. At each end of the yoke 32 the lower face engages with a compression spring 34, while a pair of projections 36 on the upper face engage with a pair of shaped leaf-springs 38, held at their centre by a pin 39A of a holder 39 made of aluminium casting. The end of each spring 38 engages in a slot of a moulded sliding lifter 40 (only one shown) made of an electrically non-conductive material and of which the upper end engages with the top and bottom sides of the moving blade 14.

It should be pointed out here that the upper spring 38 and the upper lifters 40 are not shown in FIG. 1, and that the layout of the blades 12 is not only mirrored, but is symmetrical and balanced about the axis of the solenoid actuator 24, thus presenting a consistent deflecting and actuating force via the two pairs of lifters 40 to each set of contacts in turn.

The moving blade 14 is thinned at one end for flexibility and suitably attached to the bus-bar 10 by soldering, brazing or ultrasonic welding. During manufacture of this assembly it is important not to generate excess heat, which could seriously distort the shape of, or affect the spring quality of the moving blade. Each assembly is tightly located and contained in slots and barriers within the moulded casing 8. Suitable barriers within the casing provide the required safety isolation between the two individual switches which are at mains supply voltage, and the drive coil 22 which is at low voltage.

The feed bus-bar 10 and moving blade 14 are formed in such a way that they lie parallel to each other for a certain distance, with a small defined gap between, along their length. A larger gap exists at the flexible attachment of the spring portion 12 where the blade is relatively weak, to prevent damage when loaded under fault conditions. This blade arrangement is the basis of the so-called "blow-on" layout (as described and claimed in UK Patent Application Serial No. 2295726) [ref. 480.00/B] which is designed to give increased contact force and hence superior switching performance, especially under excessive or short-circuit current fault conditions.

Under such excessive/short-circuit fault conditions the current in the feed bus-bar 10 is in the opposite direction to that flowing in the respective adjacent moving blade 14, so that electrodynamic forces are generated between them, trying to force them apart. The force is approximately proportional to the square of the current. Since the feed bus-bar 10 is comparatively rigid, these forces act directly upon the moving blade, thus increasing the forces between the contacts 16, 20 over and above the optimal overtravel force which is set when the solenoid adjustment takes place.

Opposing this increasing blow-on force, and attempting to open the contacts, is the so-called contact repulsion force, which is related to the geometry of the current flow through the contacts themselves.

The magnitude of this field-induced repulsion force is also approximately proportional to the square of the current, and is a function of the ratio of the contacting diameter to the actual contact diameter. In general the more "bedded" or "conditioned" the contacting surfaces are, the lower the repulsion forces between them. The effect of these two opposing forces is a net increase of the nominal contact force with increasing current, thus providing greatly improved and more efficient switching.

Referring to FIGS. 3A and 3B, the pair of moving blades 14 are shown in a condition in which the bifurcated contacts 16 are open.

Adjacent its contact end the moving blade 14 is formed with a slightly U-shaped portion 15 so as to freely engage with the sliding lifter 40, one half below and the other half above, for free actuation of the blade. The bottom end of the lifter 40 is engaged with the lower one of the two leaf-springs 38 within the holder 39 (only the bottom one being shown). Both split lifter sets are contained by and run smoothly in grooves (not shown) within the base and lid mouldings of the contactor.

As the leaf-spring holder 39 is freely pinned to the solenoid actuator plunger 26, and lies symmetrically between the two lifter/moving blade systems, this ensures that actuation forces translated from the solenoid plunger to the blades via the two leaf springs 38 are evenly distributed on both sides, thus giving similar, distributed contact forces and reliable switching. Furthermore, as each leaf spring 38 is entrapped by the central pin 39A, giving three fixing points within the holder 39, one limb on each side being pre-tensioned to exert a slightly greater pick-up force than the other, the result is that during actuation, one half blade contact is slightly advanced with respect to the other, creating an early closure with its mating fixed contact, followed rapidly with closure of its counterpart.

The pre-tensioning is designed in such a way that at the end of the stroke or overtravel, all four contacts 16, 20 receive approximately the same, consistent nominal contact force. Also, by virtue of the blow-on electrodynamic forces, a considerably lower nominal contact force is required for operation at normal current levels, in this case 200 A rms. Typically, each contact force is in the region of 300 to 400 g (3 to 4 Newtons).

This is the basis of a "sacrificial" contact pair on each set; one contact taking the brunt of the early closure and late opening, with the other contact carrying the load current. In practice, however, both contacts should share the load current equally.

The advantages of bifurcated contacts with such a sacrificial contact pair are as follows:

a) Since the total load current is equally shared between the bifurcated contact sets, it can be shown that the total heating effect is approximately halved.
b) Halving of the load current through each pair of "sharing" contacts more than halves the total resultant contact repulsion force which is attempting to open the contacts.
c) The combined effect of a) and b) above allows a lower leaf spring force to be utilised.

This also makes the blow-on layout less critical, while still giving an improved reliable switching life to the contactor.

The solenoid actuation 24 is latched by rare earth magnets 37 and only requires a short DC pulse for its operating and release functions, the latched hold force being considerably greater than the total contact force exerted via the double leaf-springs 38. This surplus hold ensures that the contactor function is not susceptible to shock and vibration, or excess current forces.

The actuator thus being magnet latching, and only requiring a short momentary DC pulse to perform the operating and release functions, no quiescent power is necessary. This virtually eradicates any self-heating, as is the case in a non-magnet latching solenoid. Typical coil actuation power is only of the order of 20 to 30 W (compared with 2000 W for the known contactors cited earlier), with actuation times of typically 20 ms.

As shown, the solenoid actuator 24 is wound for a single coil, requiring e.g. a positive DC pulse to operate (CLOSE) and a negative DC pulse to release (OPEN) the contactor switches, and requiring a simple reversing-bridge type of drive circuit. Alternatively, however, the solenoid may be wound with two coils with a common center tap, requiring DC pulses of the same polarity (say negative going with respect to a positive center-tap common, from separate conducting transistors), so as to achieve the operating (CLOSE) and release (OPEN) contactor functions.

Alternatively in a preferred single coil option, drive is taken directly from the AC supply e.g. via opto-isolated triacs, where it is only necessary for a positive half-cycle to operate (CLOSE) and for a negative half-cycle to release (OPEN) the contact function.

In this case, it is advantageous for the triac drive to be triggered from the so-called zero-crossing of the supply, ensuring that the contacts open and close on a rapidly declining load current (or preferably at the next zero-crossing), resulting in minimal arcing, enhanced switching and longer contact life.

To assist the release function, the two push-off springs 34 are located between the leaf spring holder 39 and the contactor casing 8. The solenoid axial position is adjustable so that a minimum contact force is achieved, which is then fixed with a pair of screws 54 (see FIG. 4) in holes in the casing, and glued for added retention during the contactor life. A moulded top cover provided with suitable catches, tightly contains and integrates the entire assembly within the casing.

Referring now to FIGS. 2A to 2D there is shown a secondary U-frame 42 for shrouding the solenoid.

The frame comprises a base 44, a pair of sides 48, from each of which extends a fixing lug 48, a top side 50 and a lower end 52 having a small central hole 54. The lugs 48 are secured to the moulded base 8 by fasteners, as shown in FIG. 1.

The frame 42 thus consists of a four-sided box structure, which is also enclosed at the lower end, and by the aluminium holder 39 beyond its upper end, thereby excluding large magnetic fields produced by the blade assemblies during excess or short-circuit fault conditions.

Auxiliary status switch for actuator/contactor function

Figure 4:
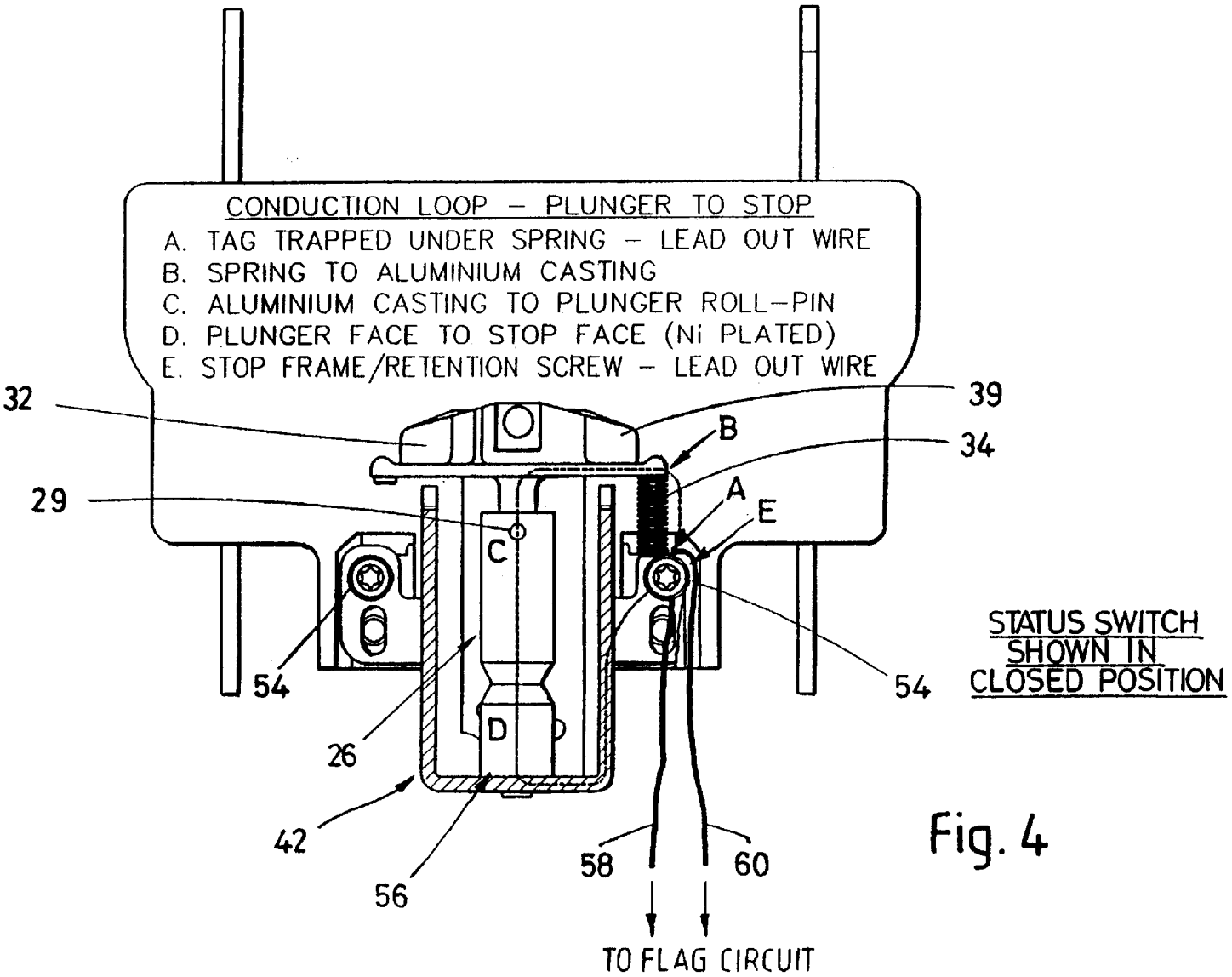
FIG. 4 is a plan view showing a status switch in the closed position.

Some end applications require an auxiliary low-voltage switch, for signalling to the drive electronics, or indicating remotely, as part of a pre-payment or Automatic Meter Reading (AMR) system, the status of the contactor (or at the very least, the status of the solenoid actuator). A simple version of such a status switch is shown in FIG. 4.

While the contacts 16 and 20 are open, the moving plunger 26 is isolated in a plastic bobbin from a metal end stop 56 and the solenoid frame 42 (at the bottom end) by the stroke distance, typically 2–3 mm. However, the plunger is in continuity with the aluminium leaf-spring holder assembly and both push-off springs 34.

As already mentioned, the functionality of the present contactor relies upon the successful latching of the magnet solenoid, fundamentally involving a strong, intimate attraction of the metallic plunger 26, the stop 54 and frame 42, when the contacts are closed. This latching hold force is typically several kilogrammes, and forms an ideal low-voltage, low-current switch.

A wire connection 58 is made to one of the fixing screws 54 for the frame 42, and a similar wire connection 60 is made to the adjacent push-off spring 34 by means of a tag (not shown) trapped under the spring. The wire connections 58 and 60 are fed to a flag circuit to show the status of the switch.

When the contactor is in the closed position shown, a continuity loop is formed as shown by the dotted line 62. Thus an electric circuit is formed as follows: from the wire 60 through the spring, along one arm of the aluminium yoke 32, through the pivot pin 29 and the plunger 26, across the nickel plated interface with the stop 56, along the side of the frame 42, and out from the screw 54 to the wire 58. The wires 58 and 60 are fed to a flag circuit to show the status of the contactor, e.g. by a indicator light (not shown).

Immunity to large generated magnetic fields

Some USA and IEC specifications require normal operation of the contactor following a 6,000 A rms 6 cycle, or a 10,000 A rms ½ cycle fault. During such excessive/short-circuit faults very large magnetic fields are generated by the bus-bars 10, the moving blades 14 and load wiring connections.

The effect of these large magnetic fields is to interfere with or influence the standing hold conditions of the magnet latch solenoid which in some cases may actually force the solenoid to drop out, opening the contactor contacts, with catastrophic consequences.

The interfering magnetic fields may enter a magnet latching solenoid in three ways:

1) by inducing forces via the plunger end face at the leaf spring carrier 39 (which is in close proximity to one of the moving blades), thus directly affecting the nett hold of the solenoid to the point of dropping out, or
2) by inducing forces directly into the plunger 26 and/or end-stop parts within the coil area, again affecting the nett hold of the solenoid, or
3) by partially demagnetising conventional existing Ferrite magnets 37 momentarily during actuation.

In order to reduce the effect of the large interfering magnetic fields at fault conditions the present design provides the following features:

1) The ferrous plunger 26 is shortened so that only the magnetically-active portion is contained within the magnet latch solenoid, the external actuation portion linking it to the aluminium leaf-spring holder 39 being non-magnetic eg. insert-moulded plastic or an extension of the holder 39. This considerably reduces the interfering influence of the large fault-condition magnetic fields.
2) The rest of the solenoid is shrouded and enclosed by the secondary U-frame 42, such that further reduction is achieved in the interfering influence of the large magnetic fields.
3) The use of rare-earth magnets 37 which not only provide considerably higher hold forces, but also makes them inherently difficult to demagnetise because of their greater bulk B.H.max product, which is typically 30 to 35 Mega.Gauss.Oersteds (MGO) compared with 3 to 6 MGO for the best grades of Ferrite material that are currently used.

The combination of these three improvements is believed to virtually eradicate the problem of the magnetic field influence, giving a reliable, immune, solenoid performance under the most arduous excess/short-circuit fault conditions.

What is claimed is:

1. A two-pole contactor comprising a solenoid having an actuator plunger, a fixed contact and a movable contact for each pole, each movable contact being mounted on a free end of a pivotable blade, the two blades being mounted in the contactor in a symmetrical mirror-image arrangement, in which the actuator plunger is connected to the center of a leaf spring having two ends, each end of the leaf spring engaging a respective said blade via a movable member, to thereby impart corresponding similar movements to the two blades.

2. A contactor as claimed in claim 1 in which an end of each blade opposite said free end is connected to a respective inlet bus-bar by a flexible spring portion, each blade and respective bus-bar being disposed in a parallel relationship, so that in operation electromagnetic forces urge each movable contact into closer contact with the respective fixed contact.

3. A contactor as claimed in claim 1 in which each blade is divided or bifurcated to provide two movable contacts for each pole.

4. A contactor as claimed in claim 1 and further comprising a housing formed as a moulding in two halves, so that components of the contactor can be assembled into one of said two halves.

5. A contactor as claimed in claim 4 in which each said end of the leaf spring engages with said movable member which is connected to a respective blade and which is slidable in a groove of one of said halves of the housing.

6. A contactor as claimed in claim 1 in which there are two movable members for each pole, one being disposed above and the other below a respective blade.

7. A contactor as claimed in claim 1 in which the solenoid is adjustably mounted by fixed screws for positioning of the plunger.

8. A contactor as claimed in claim 1 in which each movable member is made of an electrically conductive material connected to a respective blade.

* * * * *

UNITED STATES PATENT AND TRADEMARK OFFICE

CERTIFICATE OF CORRECTION

PATENT NO. : 6,292,075 B1
DATED : September 18, 2001
INVENTOR(S) : Richard Anthony Connell and Brian Stanley Darlow It is certified that error appears in the above-identified patent and that said Letters Patent is hereby corrected as shown below:

Title page,
Item [22] PCT filing date is "December 26, 1998" change date to -- February 26, 1998 --.

Signed and Sealed this

Twenty-eighth Day of May, 2002

*Attest:*

*Attesting Officer*

JAMES E. ROGAN
*Director of the United States Patent and Trademark Office*